United States Patent [19]

Koenig

[11] 4,076,027

[45] Feb. 28, 1978

[54] FLUID TRANSFER DEVICE

[75] Inventor: Elmer A. Koenig, Kirkwood, Mo.

[73] Assignee: Sherwood Medical Industries Inc., St. Louis, Mo.

[21] Appl. No.: 684,139

[22] Filed: May 7, 1976

[51] Int. Cl.[2] ..... A61J 1/08

[52] U.S. Cl. ..... 128/272; 210/251; 210/450; 128/218 D

[58] Field of Search ..... 210/251, 450, 496; 128/214 R, 214 F, 216, 218 D, 218 M, 272, 272.1, 272.2, 272.3

[56] References Cited

U.S. PATENT DOCUMENTS

| | | | |
|---|---|---|---|
| 1,503,220 | 7/1924 | Wedig | 128/218 R |
| 2,222,123 | 11/1940 | Schwab | 210/251 |
| 2,251,501 | 8/1941 | Smith | 128/218 D |
| 2,690,179 | 9/1954 | Fox | 128/216 |
| 2,717,598 | 9/1955 | Krasno | 128/216 |
| 2,769,444 | 11/1956 | Henderson | 128/216 |
| 2,778,360 | 1/1957 | Miskel | 128/218 |
| 2,817,337 | 12/1957 | Herzig | 128/214 R |
| 2,977,014 | 3/1961 | Kock | 215/12 |
| 3,128,917 | 4/1964 | Krause | 128/214 R |
| 3,354,883 | 11/1967 | Southerland | 128/272.1 |
| 3,459,185 | 8/1969 | Bender et al. | 128/272 |
| 3,537,605 | 11/1970 | Solowey | 128/218 M |
| 3,542,240 | 11/1970 | Solowey | 128/214 R |
| 3,592,245 | 7/1971 | Levi et al. | 128/272 R |
| 3,720,341 | 3/1973 | Greenfield et al. | 206/498 |
| 3,817,389 | 6/1974 | Weichselbaum | 210/448 |

*Primary Examiner*—Frank W. Lutter
*Assistant Examiner*—David L. Lacey
*Attorney, Agent, or Firm*—Stanley N. Garber; William R. O'Meara

[57] ABSTRACT

A container having a sealed chamber for receiving an ampule containing a parenteral solution. The container device has a luer tapered connector for connection with a luer tapered coupling element of another device, such as a hypodermic syringe barrel tip. Between the connector and the chamber is a filter for filtering the parenteral solution as it is discharged from the ampule. The container device may be formed of a pliable material such that a glass ampule within the chamber can be broken by hand-squeezing the container. The container may also be formed of a pair of relatively rigid threadedly coupled members with a glass ampule between the members and such that the two members can be rotated to move the members together and break the glass ampule. The container device may also be provided with a pair of threadedly coupled upper and lower relatively rigid members having a seal on the interior of the upper member engaged with the open end of the ampule. In the latter case, a glass ampule may be broken or opened outside of the container and then placed inside the container so that the solution within the opened ampule can be filtered through a filter in the container.

12 Claims, 4 Drawing Figures

FIG. 1
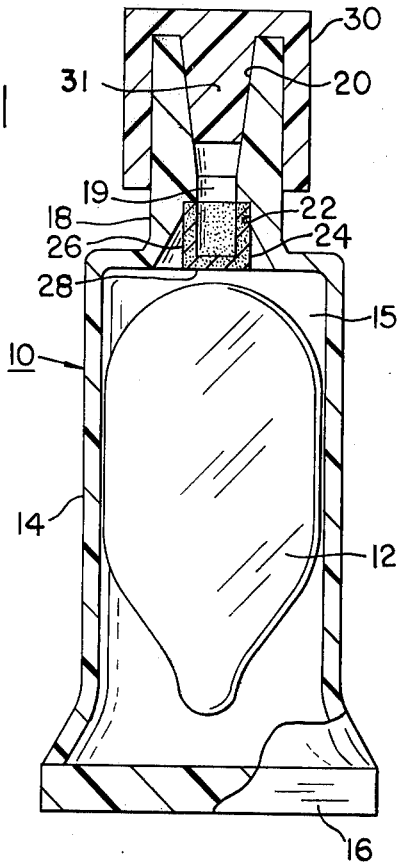
FIG. 2
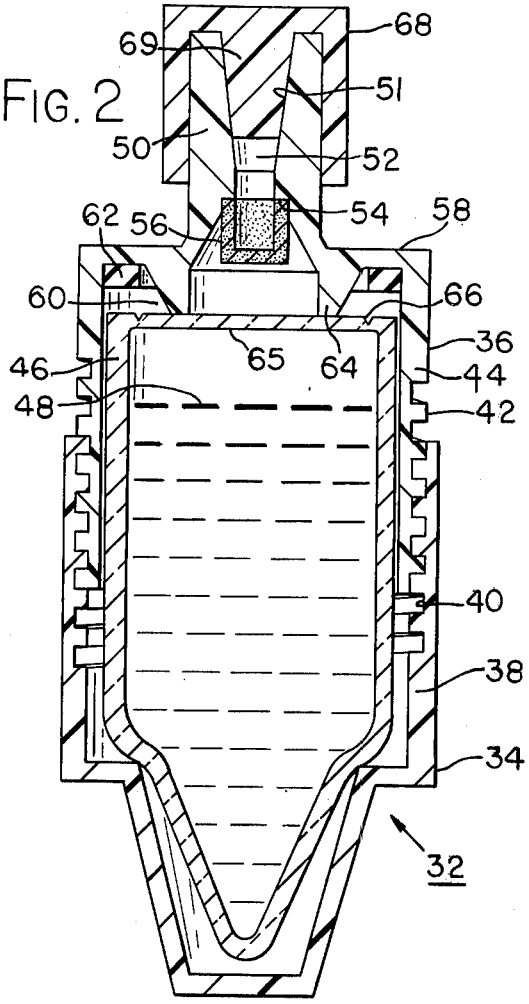
FIG. 3
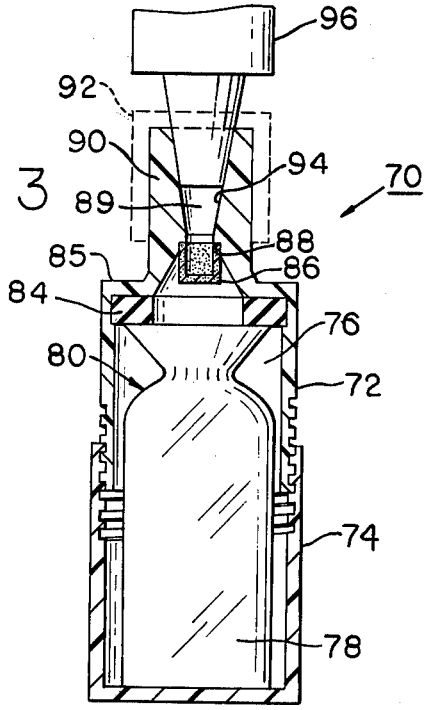
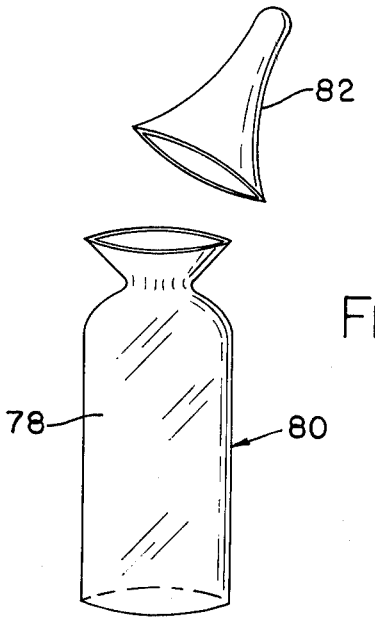
FIG. 4

FLUID TRANSFER DEVICE

BACKGROUND OF THE INVENTION

This invention relates to fluid transfer devices and more particularly to a device for transferring a medicament or parenteral solution from an ampule to another device.

All-glass ampules are often used to store parenteral solutions because they are not only economical to manufacture but also because there is no rubber stopper or seal in contact with the solution to contaminate it. Vials and bottles on the other hand, have closures, such as rubber stoppers and pierceable seals so that, in some cases, there is contamination or danger of the solution leaking out of the container or air entering the container because of a closure failure.

However, glass ampules must be broken in order to obtain access to the solution therein and this presents the possibility of glass particles being drawn out of the ampule along with the parenteral solution. This, of course, presents the serious danger of particles being injected into the patient. Also, there is the danger that the solution may spill from the ampule when broken open leaving a smaller dosage than desired. Also, there is the possibility that the person opening it will be cut from broken glass or that the solution will come in contact with the person.

SUMMARY OF THE INVENTION

Accordingly, a general object of the present invention is to provide a novel device for dispensing the contents of an ampule wherein the above-mentioned undesirable features are substantially obviated. A more specific object is to provide a container for an ampule wherein an external device for receiving the liquid from the ampule can be readily coupled to the container and wherein foreign particles are prevented from leaving the container with the liquid. A further object is to provide a novel container of the above type wherein a glass ampule can be placed in the container unopened and thereafter safely opened or broken while in the container. In accordance with one form of the present invention, a container has a chamber for receiving an ampule and is provided with coupling means for receiving a coupling element of an external device adapted to receive the liquid contents of the ampule. A filter is disposed within the container for filtering the liquid contents discharged from the ampule. In accordance with another aspect of the present invention, a container is provided which has a chamber for receiving an ampule, means for opening the ampule while in the container, coupling means for connection with an element to receive the liquid from the open ampule, and a filter for filtering the liquid from the ampule.

BRIEF DESCRIPTION OF THE DRAWING

FIG. 1 is an elevational cross-sectional view of a container containing an ampule in accordance with a preferred embodiment of the present invention;

FIG. 2 is an elevational cross-sectional view of a container for an ampule in accordance with another preferred embodiment;

FIG. 3 is an elevational cross-sectional view of a container for an ampule in accordance with still another preferred embodiment; and FIG. 4 is a perspective view of an opened ampule.

DESCRIPTION OF THE PREFERRED EMBODIMENTS

Referring now to the drawing, and more particularly to FIG. 1, a fluid transfer container in accordance with a preferred embodiment of the invention is indicated generally at 10. Container 10 is shown enclosing a glass ampule 12 containing a parenteral solution. The container 10 is formed of a pliable material such as ethylene vinyl acetate or other suitable plastic. The container is preferably injection molded to provide a main body 14 which is generally tubular and provides a sealed chamber 15. In manufacturing the container 10, the lower end of body 14 is flattened and the opposed sides cemented or welded together to form a sealed end 16 at the bottom after ampule 12 has been inserted in the body. The body 14 is also formed with a generally cylindrical upper end portion 18 of reduced diameter but which is shown with walls thicker than those of other portions of the body.

The upper end portion 18 serves as a fluid coupler or luer tapered connector having a through bore 19 extending from the chamber 15 to the upper end of luer tapered connector 18. A female luer tapered connector or bore portion 20 is provided at the upper end of the bore 19 for receiving a male luer member of an external connector, such as a conventional luer tapered syringe barrel tip or other complementary coupling element. The luer tapered connector 18 is also formed with an internal, annular recess 22 at the lower end of bore 19 for sealingly receiving a filter element 24 which may be heated and press-fitted and/or cemented into the recess 22. Preferably, the filter is porous metal filter made by a process including compacting a mass of stainless steel particles and a lubricant in a mold, heating the mass to remove the lubricant, and sintering the mass, as disclosed in copending application Ser. No. 354,309, filed Apr. 25, 1973, now U.S. Pat. No. 3,933,652, and commonly assigned. The filter 24 may be secured in the container 10 by a method described in U.S. Pat. No. 3,817,389. Filter 24 is shown in FIG. 1 as being cup-shaped and having a cylindrical portion 26 frictionally fitted into recess 22, with the open end at the top and the closed end at the bottom which is indicated at 28.

A closure cap 30 is applied over the luer tapered connector 18 to sealingly close the luer tapered bore 20. The cap 30 may be heat-staked or spot-welded to the connector 18 such that the weld is readily broken upon relative rotation of the cap 30 and container 10 when it is desired to remove the cap. Cap 30 is shown with a central tapered portion 31 disposed in tapered bore 20.

In use, the exterior of the body 14 of container 10 can be hand-grasped and the body squeezed or crushed to break the glass ampule 12 within the container. The cap 30 is removed and an external device (not shown), such as a syringe, luer tapered coupling element for infusion apparatus, or other coupling element having a male luer tapered tip, is inserted into the luer tapered bore 20 and tightly fitted therein to form a liquid tight seal. When a syringe is used, the syringe tip is inserted into bore 20, and the syringe piston is moved in the syringe barrel to draw the solution from the chamber 15. All of the fluid from the ampule and chamber 15 must flow through the filter 24 and into the passage 19 to the syringe. Filter 24 prevents particles of glass or other materials from being drawn out of the container.

A fluid container in accordance with a modified embodiment is indicated generally at 32 in FIG. 2. Container 32 has a lower generally cup-shaped member 34 and an upper relatively movable cup-shaped member 36. Member 34 has an upper cylindrical portion 38 with internal threads 40 which receive external threads 42 on a lower cylindrical portion 44 of the upper member 36 so that the two members are in telescopic relation and relatively movable axially toward and away from each other when rotated relative to each other. Disposed within the container 32 is a glass ampule 46 having a parenteral solution 48 therein.

The upper member 36 is provided with an upper cylindrical portion or luer tapered connector 50 of reduced diameter having a female luer connector position or luer tapered bore 51 adapted to receive a male syringe barrel tip or other male luer tapered coupling element. The tapered bore 51 connects with a passage 52 that communicates with a recess 54 for receiving a porous metal filter element 56 press-fitted therein. The upper member 36 has a shoulder 58 integrally connected between the upper luer connector portion 50 and the threaded lower portion 44. The upper and lower container members 34 and 36 define an interior chamber 60 having an annular sealing element or washer 62 of elastomeric material, such as rubber, disposed under the shoulder 58 of the upper member. The interior side of the member 36 under the shoulder 58 is also provided with a downwardly extending, integral engagement member 64 in the form of an annular ring which is adapted to engage an upper end wall 65 of the ampule 46. The end wall 65 is provided with a circular recess or line of weakness 66.

Before the upper and lower members 34 and 36 are connected together, ampule 46 may be inserted into the lower member 34 with the bottom of the ampule 46 engaging the bottom portion of the lower member as shown. The upper member 36 may then be threaded into the lower member 34 until the ring 64 just touches or is slightly spaced from the upper end 65 of the ampule. The ampule 47 may be inserted by the manufacturer or subsequently, such as at the time of use. The upper cylindrical connector portion 50 of member 36 is also provided with a cap 68 having a tapered plug portion 69 closing the bore 51 and passage 52 during storage.

When it is desired to transfer the parenteral liquid 48 from the container 32, the upper and lower members 34 and 36 are grasped and the members rotated relative to each other in a direction to move the members toward each other, whereupon, the annular ring 64 applies a force on the upper end 65 of the ampule causing it to break along the circular line of weakness 66 effecting fluid communication between the passage 52, and the interior of the ampule. The two members 34 and 36 are rotated until the peripheral portion of the upper end 65 or side wall of the ampule sealingly engages the seal 62 to prevent leakage of the solution 48 along the threads 40 and 42. The container 32 may be held with the luer tapered connector 50 at the top when breaking the ampule end wall 65 so that the solution does not enter into any space between the upper and lower members 34 and 36. The cap is removed and a male luer tapered coupling element for a syringe or the like is sealingly connected in the luer connector bore 51. The solution 48 can then be drawn out of the ampule through the filter 56 and into the syringe or other device.

Where desired, the central portion of the ampule end 65 or portion radially inwardly of the annular groove 66, can be broken before being placed in the container 32. For example, before the members 34 and 36 are threaded together, the ampule may be opened by any suitable means, placed in the lower member 34, and then the upper member 36 threaded into the lower member until the sealing ring 62 engages the peripheral edge of the upper open end of the ampule.

FIG. 3 shows a further modified embodiment wherein a container 70 is shown which is similar to the container 32 of FIG. 2 except that the ring 64 of container 32 for breaking one end of the ampule is not provided. The container 70 includes a pair of telescoping, upper and lower threaded members 72 and 74 defining a chamber 76 in which is disposed a bottom portion 78 of an opened glass ampule 80. The glass ampule 80 is shown in FIG. 4 having an upper portion 82 broken away from the bottom portion 78, for example, as determined by a line of weakness or scoreline encircling the ampule between the upper and lower portions. Disposed in the upper container member 72 is a seal 84 of resilient elastomeric material under a shoulder 85, and a filter 86 is fixed in a recess 88 at the lower end of a passage 89 extending through an upper luer tapered fluid connector 90. A closure cap 92, shown in phantom, is disposed on the upper end of the luer tapered connector 90 to close the upper end of the passage 89. Connector 90 is provided with a luer tapered bore indicated at 94.

In the embodiment illustrated in FIG. 3, the threadedly coupled container members 72 and 74 may be separated from each other by rotating one relative to the other. The ampule, while outside the container, is opened by breaking the upper end 82 from the lower portion 78 as indicated in FIG. 4. The bottom ampule portion 78 is then placed in the lower member 74 of the container 70, and the upper member 72 inserted over the ampule portion 78 and into the lower open member 74 of the container 70. Member 72 is then threaded into the lower member 74 until the seal 84 engages and seals the peripheral edge at the upper end of the ampule portion 78. Then the cap 92 may be removed and the barrel tip of a syringe, indicated at 96, or other male luer tapered coupling element, is inserted into the luer tapered bore 94 and rotated into fluid tight engagement. The parenteral solution in the ampule portion 78 is then drawn from the interior of the ampule portion 78 and into the barrel of syringe 96. All of the solution passing from the ampule portion 78 to the syringe must necessarily pass through the filter 86 so that particles, such as glass particles, are prevented from passing out of the container and into the syringe 96.

The advantages of being able to readily transfer liquid from the container to another device by means of the luer tapered connector, and of filtering the liquid, are obtained even where the glass ampule is opened before placing it in a container, such as container 32 or 70. It is, of course, highly advantageous to open or break the glass ampule while in the container so as to obtain the protection of the container. For example, the dangers of cutting the user and of spilling the liquid contents of the ampule can be avoided by breaking the ampule while in the container. Also, by placing the ampule unopened into the container, the container can serve as a package for the ampule, and the single unit of container and ampule can be readily handled and economically stored.

As various changes could be made in the above construction without departing from the scope of the invention, it is intended that all matter contained in the above description or shown in the accompanying drawing shall be interpreted as illustrative and not in a limiting sense.

What is claimed is:

1. In combination, a container, and at least a portion of a glass ampule containing a parenteral liquid, said container comprising first and second relatively rigid members connected together to define a chamber shaped to receive said ampule portion, said ampule portion being disposed in said chamber, coupling means on each of said members engageable with each other to connect said members together and permit relative axial movement of said members while connected together and permit separation of said members to permit said ampule portion to be positioned axially between said members within said chamber, said first member having luer tapered coupling means for receiving a complementary luer tapered coupling element, passage means extending from said luer tapered coupling means to said chamber, and filter means in said first member for filtering liquid when it flows from said ampule portion through said passage to said luer tapered coupling means, said members being axially movable toward each other to clamp said ampule portion axially between portions of said members, and means for sealing said chamber against the flow of liquid from said ampule to the exterior of said container.

2. The container of claim 1 wherein each of said coupling means includes a threaded portion threadedly coupled to the threaded portion of the other member so that relative rotation of said members causes them to move axially relative to each other.

3. The container of claim 2 wherein said glass ampule is an unopened glass ampule containing said parenteral liquid, and said first member has abutment means thereon adapted to engage and break open an end portion of said ampule in response to relative movement of said members toward each other.

4. The container of claim 3 wherein said seal means is annular and is clamped between said first member and said end portion of said ampule upon predetermined relative rotation of said members.

5. The container of claim 3 wherein each of said members is generally cup-shaped with the open end of one of said members threadedly receiving the open end of the other of said members.

6. In combination, a container and a glass ampule containing a parenteral liquid, said container comprising upper and lower relatively rigid members defining a chamber shaped to receive said ampule, said ampule being disposed in said chamber, said members being threadedly coupled together for relative axial movement in response to relative rotation thereof, said upper member having luer tapered coupling means for receiving complementary luer tapered coupling means, a fluid passage extending between said chamber and said luer tapered coupling means, and a filter disposed in said upper member to filter said parenteral liquid when flowing from said ampule through said passage to said luer tapered coupling means, said members being relatively rotatable to clamp said ampule therebetween and to effect a force on said ampule sufficient to break and open said ampule and thereby connect the interior of said ampule in fluid communication with said luer tapered coupling means.

7. The combination of claim 6 wherein said ampule has an end portion scored to weaken a part thereof, and one of said members has abutment means thereon engageable with said weakened part to break said part from said end portion when said ampule is opened.

8. The combination of claim 7 wherein said one member is said upper member and includes an elastomeric seal engaging said end portion of said ampule at least after said ampule is opened to prevent liquid from said ampule from flowing axially between the inner side walls of said chamber and the outer side walls of said ampule.

9. The combination of claim 8 wherein each of said members is generally cup-shaped with the open end of one of said members threadedly receiving the open end of the other of said members.

10. The combination of claim 9 wherein said open end of said upper member has a greater diameter than that of said luer tapered coupling means and is connected thereby by an annular radially extending shoulder, and wherein said elastomeric seal is annular and disposed between said shoulder and the upper end of said ampule and extends around said abutment means.

11. The combination of claim 7 further including a removable closure cap sealingly closing said passage and luer tapered coupling means.

12. The combination of claim 7 wherein said filter is a porous metal filter of sintered and compacted metal particles.

* * * * *